US007506774B2

(12) United States Patent
Willim

(10) Patent No.: US 7,506,774 B2
(45) Date of Patent: Mar. 24, 2009

(54) MOBILE CRANE

(75) Inventor: Hans-Dieter Willim, Ulm-Unterweiler (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 0 days.

(21) Appl. No.: 11/525,236

(22) Filed: Sep. 20, 2006

(65) Prior Publication Data

US 2007/0068889 A1 Mar. 29, 2007

(30) Foreign Application Priority Data

Sep. 26, 2005 (DE) ..... 20 2005 015 151 U

(51) Int. Cl.
*B66C 23/04* (2006.01)

(52) U.S. Cl. ..... 212/231; 212/348

(58) Field of Classification Search ..... 212/231, 212/232, 348
See application file for complete search history.

(56) References Cited

U.S. PATENT DOCUMENTS

| | | | | |
|---|---|---|---|---|
| 3,620,579 | A | 11/1971 | Brown | |
| 4,984,695 | A | 1/1991 | Goto | |
| 6,893,189 | B2 * | 5/2005 | Matsushita et al. | 405/155 |

FOREIGN PATENT DOCUMENTS

| | | | |
|---|---|---|---|
| DE | 199 33 232 | A1 | 4/2000 |
| DE | 202 03 909 | U1 | 7/2003 |
| EP | 0943578 | | 9/1999 |
| JP | 7-165385 | * | 6/1995 |
| JP | 07-267583 | * | 10/1995 |
| JP | 07267583 | | 10/1995 |
| JP | 08020490 | A | 1/1996 |
| JP | 8-324973 | * | 12/1996 |

* cited by examiner

*Primary Examiner*—Thomas J. Brahan
(74) *Attorney, Agent, or Firm*—Alleman Hall McCoy Russell & Tuttle LLP

(57) ABSTRACT

The present disclosure relates to a mobile crane comprising a superstructure having a revolving deck and at which a preferably telescopic boom is pivotably arranged around a pivot point, with a winch being additionally present for the hoist rope. In accordance with the present disclosure, the winch is arranged beneath the pivot point of the telescopic boom in the revolving deck.

5 Claims, 1 Drawing Sheet

MOBILE CRANE

CROSS REFERENCE TO RELATED APPLICATION

This application claims priority to German Utility Model Application Ser. No. 20 2005 015 151.3, filed on Sep. 26, 2005, the disclosure of which is hereby incorporated by reference in its entirety for all purposes.

FIELD

The present disclosure relates to a mobile crane comprising a superstructure having a revolving deck at which a preferably telescopic boom is pivotably arranged around a pivot point, with a winch being additionally present for the a hoist rope.

BACKGROUND AND SUMMARY

A vehicle crane typically has an undercarriage and a superstructure as well as a swiveling crown and a boom. The superstructure can be rotated with respect to the undercarriage via the swiveling crown. The boom, which is designed to be telescopic as a rule, is pivotably arranged around a pivot point on the superstructure. The superstructure furthermore carries a winch onto which the hoist rope can be wound.

A mobile crane in accordance with the prior art is shown by way of example in FIG. 1. The mobile crane 10 shown there has a biaxial undercarriage 12 and an upper carriage 14 arranged on and rotatable by means of a swiveling crown not shown in any more detail here. The superstructure 14 has a telescopic boom 16 which is arranged pivotably around a pivot axis 18 on the revolving deck 20 of the superstructure 14. In the embodiment shown here, the mobile crane has a driver's cabin 22 and a crane operator's cabin 24 which is arranged on the revolving deck of the superstructure. In the mobile crane in accordance with the prior art, a hoist rope winch 26 is arranged behind the pivot point of the telescopic boom formed by the pivot axis 18. This arrangement of the winch 26 extends the boom length to the rear in the transport condition. This means that the swivel radius of the crane is enlarged by the installation length of the winch or that the boom projects to the front, that is in the direction of the driver's cabin 22 in the present case, comparatively far beyond the vehicle in the transport condition.

It is the object of the present disclosure to be able to equip a mobile crane with a comparatively longer boom without enlarging the swivel radius of the crane or the overhang of the boom in the transport condition.

This object is solved in accordance with the present disclosure by a mobile crane comprising a superstructure having a revolving deck and at which a telescopic boom is pivotably arranged around a pivot point; and a winch for a hoist rope. The winch is arranged below the pivot point of the telescopic boom in the revolving deck. On the basis of this arrangement, the boom can be offset to the rear by the length of the winch so that the boom itself projects comparatively less far beyond the driver's cabin. If the same total vehicle length should be achieved, the telescopic boom set on the revolving deck of the superstructure can be made comparatively longer.

The hoist rope is accordingly advantageously guided via a pulley block arranged on the boom. The pulley block is particularly advantageously arranged laterally displaceably on the pivot axle of the telescopic boom.

Further features, details and advantages of the present disclosure result from an embodiment shown in the drawing.

DETAILED DESCRIPTION

Figure 1:
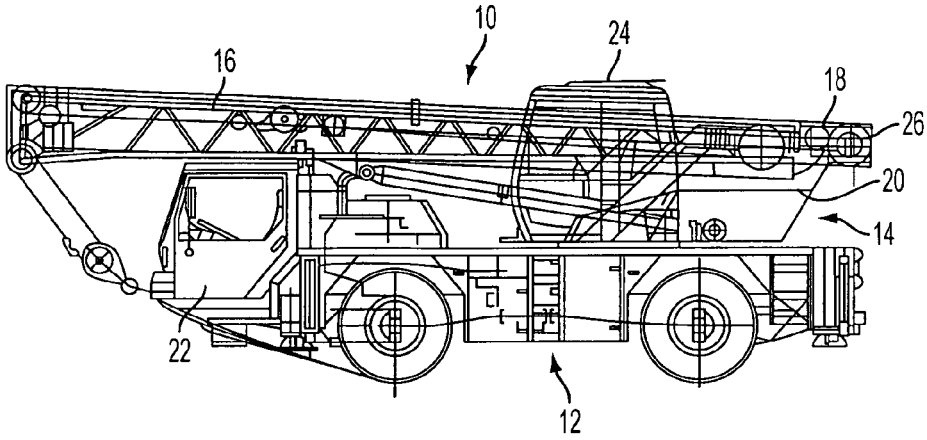
FIG. 1 shows a view of a mobile crane as embodied in prior art.
Figure 2:
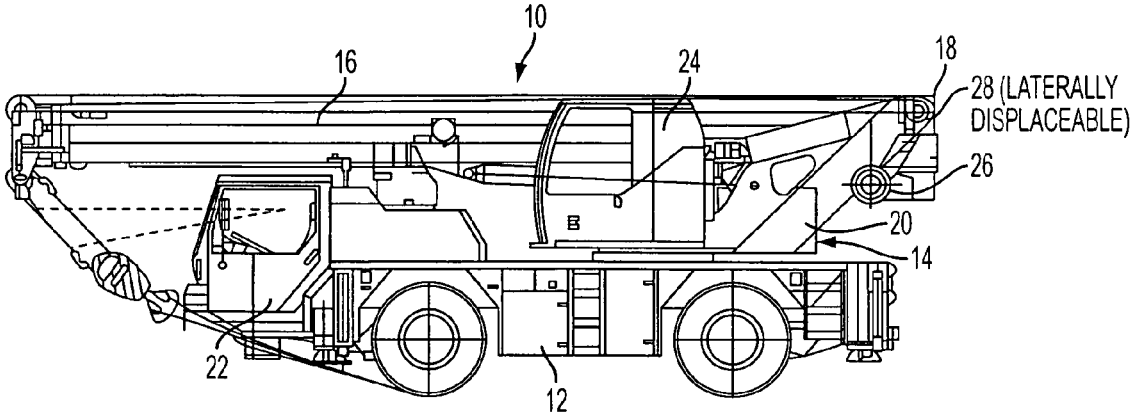
FIG. 2 shows a view of a mobile crane as presently disclosed.

FIG. 2 shows a preferred aspect of the present disclosure. Here, a mobile crane 10 is shown with a biaxial undercarriage 12. A revolving deck 20 of a superstructure 14 is supported on the undercarriage 12 via a swiveling crown not shown in any detail here. The undercarriage 12 has a driver's cabin 22. A crane operator's cabin 24 is arranged on the superstructure 14.

A central part of the superstructure is the telescopic boom 16 which is pivotable around a pivot axis 18. The pivot axis 18 in the embodiment of the present disclosure in accordance with the present disclosure is supported as far to the rear as possible in the revolving deck 20 of the superstructure 14. The hoist rope winch 26 is supported below this pivot axis 18 in the revolving deck. The hoist rope 26, which can be wound onto the winch and can be unwound from it again, is guided via a pulley 28 which is seated laterally displaceably on the pivot axis 18 of the telescopic boom. A particularly compact construction is thereby made possible. Since the construction length of the winch 26 is disposed downwardly in the revolving deck, a comparatively long boom 16 can be pivotably supported above it around the pivot axis 18.

The invention claimed is:

1. A mobile crane comprising:

a superstructure having a revolving deck at which a boom is pivotably arranged around a boom pivot axis, a hoist rope within the revolving deck;

a winch for the hoist rope, and a pulley arranged at the boom; wherein the winch is arranged beneath the boom pivot axis, the hoist rope is guided via the pulley, and the pulley is seated laterally displaceably on the boom pivot axis and within the revolving deck, wherein the pulley further guides the hoist rope within the revolving deck.

2. The crane in accordance with claim 1, wherein the boom is a telescopic boom.

3. A mobile crane comprising:

a superstructure having a revolving deck and a telescoping boom, the boom pivotably arranged around a boom pivot axis at a rearward location of the revolving deck;

a hoist rope;

a winch for the hoist rope, wherein the winch is arranged beneath and forward of the boom pivot axis of the telescopic boom in the revolving deck; and a pulley seated laterally displaceably on the boom pivot axis of the telescopic boom, wherein the hoist rope is guided via the pulley.

4. The crane in accordance with claim 3, further comprising a biaxial undercarriage coupled below the superstructure.

5. A mobile crane comprising:

a superstructure having a revolving deck and a telescoping boom, the boom pivotably arranged around a boom pivot axle at a rearward location of the revolving deck; and a hoist rope;

a winch for the hoist rope, wherein the winch is arranged beneath and forward of the boom pivot axle of the telescopic boom in the revolving deck;

a pulley seated laterally displaceably on the boom pivot axle of the telescoping boom, wherein the hoist rope is guided via the pulley; and a biaxial undercarriage coupled below the superstructure.

* * * * *